United States Patent [19]

Pennison

[11] Patent Number: 4,681,158

[45] Date of Patent: Jul. 21, 1987

[54] CASING ALIGNMENT TOOL

[75] Inventor: Harold P. Pennison, New Orleans, La.

[73] Assignee: Mobil Oil Corporation, New York, N.Y.

[21] Appl. No.: 839,470

[22] Filed: Mar. 13, 1986

Related U.S. Application Data

[63] Continuation of Ser. No. 433,307, Oct. 7, 1982, abandoned.

[51] Int. Cl.[4] ..... E21B 19/00

[52] U.S. Cl. ..... 166/77.5; 166/85; 175/85

[58] Field of Search ..... 166/378, 379, 380, 77.5, 166/85; 175/85; 414/22; 269/25, 156, 287, 237–239; 81/57.2, 57.16, 57.19, 57.34

[56] References Cited

U.S. PATENT DOCUMENTS

| | | | |
|---|---|---|---|
| Re. 30,071 | 8/1979 | Hilding | 175/85 |
| 2,235,265 | 3/1941 | Shope . | |
| 2,416,815 | 3/1986 | Calhoun | 414/22 |
| 2,450,934 | 10/1948 | Calhoun | 166/77.5 |
| 2,828,024 | 3/1958 | True . | |
| 3,061,011 | 10/1972 | Paget | 166/77.5 |
| 3,177,944 | 4/1965 | Knights | 166/77.5 |
| 3,919,902 | 11/1975 | Johnson | 175/85 |
| 3,921,823 | 11/1975 | Bourree et al. | 175/85 |
| 3,976,207 | 8/1976 | Schultz | 175/85 |
| 4,221,269 | 9/1980 | Hudson | 81/57.2 |
| 4,274,777 | 6/1981 | Scaggs | 414/22 |
| 4,295,527 | 10/1981 | Russe | 166/380 |
| 4,304,433 | 12/1981 | Langowski | 294/106 |
| 4,440,220 | 4/1984 | McArthur | 175/85 |
| 4,440,536 | 4/1984 | Scaggs | 414/22 |

FOREIGN PATENT DOCUMENTS

| | | |
|---|---|---|
| 898572 | 6/1962 | United Kingdom . |
| 2063333 | 6/1981 | United Kingdom . |

OTHER PUBLICATIONS

Baker Packers, "Tech Facts", copyright 1977, pp. 1–8, 1–9.

*Primary Examiner*—Stephen J. Novosad
*Assistant Examiner*—Bruce M. Kisliuk
*Attorney, Agent, or Firm*—Alexander J. McKillop; Michael G. Gilman; Charles J. Speciale

[57] ABSTRACT

An oil well casing alignment tool is disclosed wherein a casing section that has been elevated to an upright position, aligns the upright casing and locks it in a vertical position while permitting the casing to be axially rotated until it locks it into the sealing point of the previous casing section.

1 Claim, 4 Drawing Figures

CASING ALIGNMENT TOOL

This a continuation of copending application Ser, No. 433,307, filed on Oct. 7, 1982 now abandoned.

BACKGROUND OF THE INVENTION

The present invention pertains to production well completion and more particularly to connecting well casings and their alignment to prevent thread and seal damage.

In oil well completion, or any type of well, such as water, gas, etc., it is standard practice to sink a casing once the wellbore has been drilled. A casing is designed to preserve the integrity of the wellbore. The casing is used as a conduit for well cementation and a pressurized container for production tubing.

A casing section is normally a seamless steel tube approximately forty feet in length, anywhere from four and one-half to twenty inches in diameter and may have a wall thickness in excess of one inch. The casing section is normally threaded at each end with a collar screwed on to one end in preparation for placing in a well bore.

Referring to FIG. 1, a wellbore 4 is of a significantly larger diameter than the outer diameter of a casing section 5 to allow easy placement down hole. A casing section 5 is placed in an upright position and lowered partially downhole, with a collared end 6 extending above the ground surface surrounding wellbore 4. Casing section 5 is held in place by slips 7 secured to the surface to prevent casing section 5 from further descending wellbore 4. A second casing section 5A is stood upright with its uncollared end approximately in line with collared end 6 of the previous, partially downhole section 5. Casing 5A is stood upright by a block arrangement 8 connected to a flexible cord 9 secured to casing 5A. A man referred to as the "stabber" (not shown) is located on a platform 10 on a drilling rig 11 thirty to forty feet above the ground. When the casing 5A is vertical, he throws a rope around collared end 6A of casing section 5A and attempts to line it up with collar 6 of casing section 5. Hydraulic tongs (not shown) are connected to casing section 5A and it is rotated along its center line to screw into the exposed collar 6 of the previous casing section 5. Casing section 5A is lowered into wellbore 4 and held in place by slips 7 which had been loosened to permit lowering of casing 5A and tightened to hold casing section 5A. The procedure is repeated until casing sections the length of the wellbore have been put in place.

Modern hydrocarbon wells are of increasing depth and a well twenty thousand feet deep is not uncommon. This depth requires five hundred casing sections or approximately five hundred joints, where one casing section is married to another.

Since the "stabber" is forty feet from the joint and must be significantly far from the centerline he is attempting to coincide, misalignment problems can often occur. Misalignment of one inch at the stabber position can damage threads to prevent a positive seal between casings. Misalignment of four inches at the stabber position will gall the threads and ruin the seal between casing joints. Misalignment of twelve inches at the stabber position will result in crossthreading.

In previous hydrocarbon production wells, depths of only a few thousand feet were common and a seal problem was of minimal concern since high pressure is not associated with shallow wells. Presently, casing sections must be able to withstand many thousand pounds of pressure and a poor seal may washout surrounding formations despite cementing the casings in place.

Furthermore, a casing section may weigh as much as ninety pounds per foot. While the casing may be rated to hold six hundred tons and the joint strength may be eighty percent or four hundred eighty tons, a joint made up having its threads damaged or galled will be significantly less. As a result, a joint may separate sending several thousand feet of casing downhole. The casing must either be recovered or a smaller diameter casing lowered within the casing that was dropped. Since a fall of more than ten thousand feet, (approximate two miles) may have damaged and broken the solid casing joints, several millions of dollars extra may be required to complete the well.

SUMMARY OF THE INVENTION

The present invention provides a method and apparatus for positive alignment of casing sections used to preserve the integrity of wellbores. An alignment yoke is fixed to a drilling rig. The yoke is aligned with the center line of the wellbore below. A casing section is lifted vertically upright and brought near the yoke and lowered to touch the collar of the previous casing section. The yoke is closed, clamping the casing in position with rotatably mounted bearings positioned along the inner periphery of the yoke. The casing section may then be rotated to connect to the collar of the previous casing section.

DESCRIPTION OF THE PREFERRED EMBODIMENT

Figure 2:
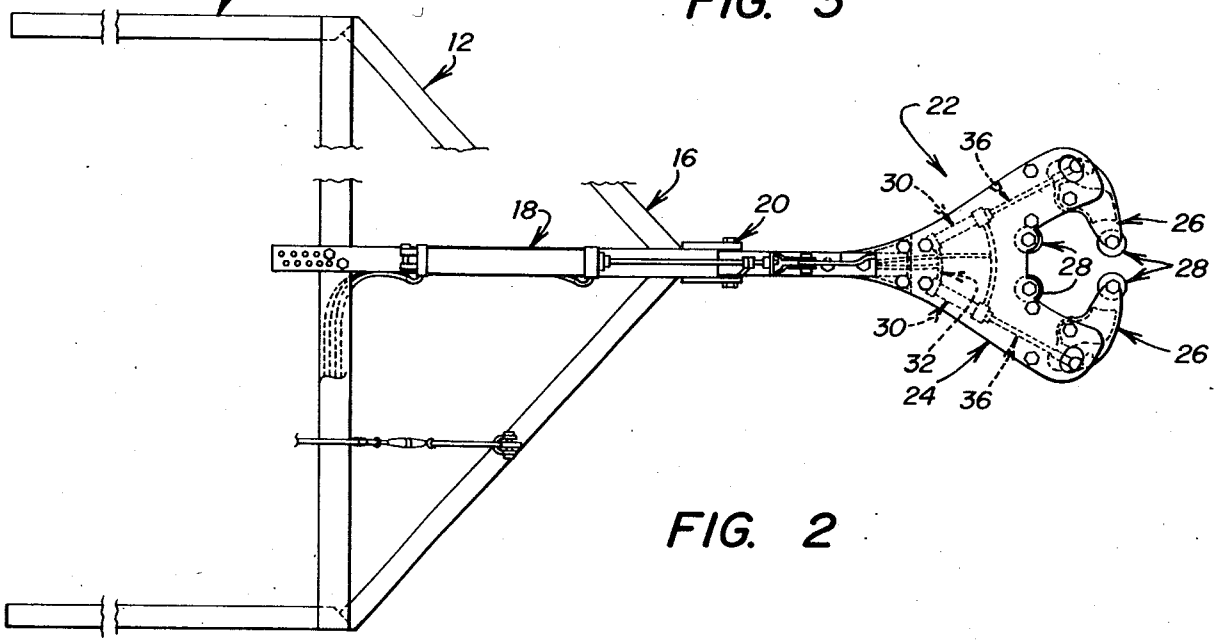
FIG. 2 is a plan view of a casing alignment tool assembly.

FIG. 2 illustrates a plan view of a casing alignment tool assembly as having a frame 12 with base member 14 angled support members 16 and centerpiece 18. A portion of center member 18 extends past the intersection of angled members 16 and contains a pivot point 20. Attached at pivot point 20 is casing alignment tool 22 having head assembly 24, roller arm assemblies 26 and rollers 28. Illustrated in phantom are pneumatic cylinders 30, air pressure flowlines 32 and 34 and piston connections 36.

Figure 1:
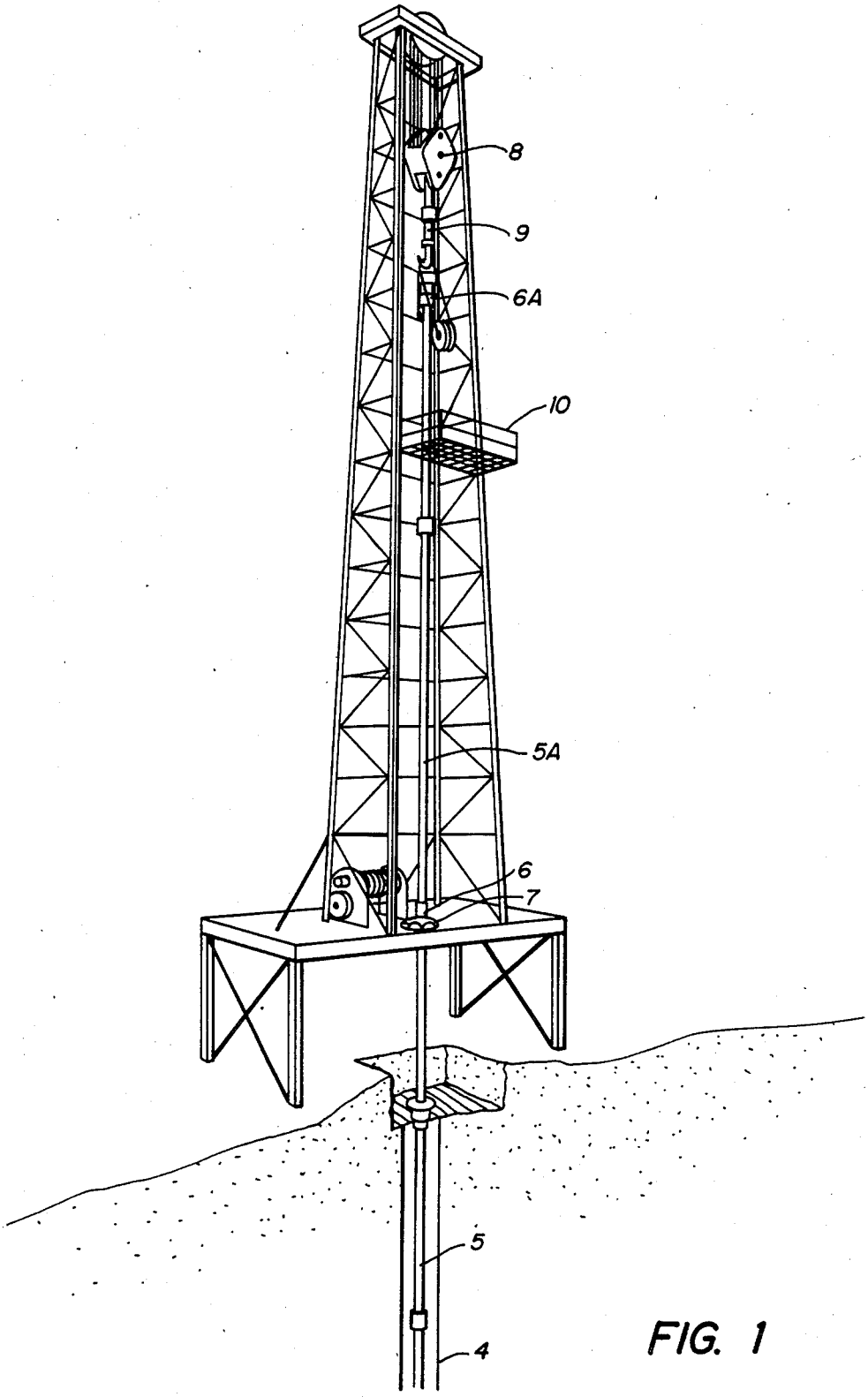
FIG. 1 is a view of a well site.

In operation, base member 14 of mounting frame 12 may be attached to any structure in close proximity to a pre-drilled wellbore, the only requirement being that the centerpoint defined by rollers 28 is capable of being aligned with the center of the wellbore. (see FIG. 1)

Figure 3:
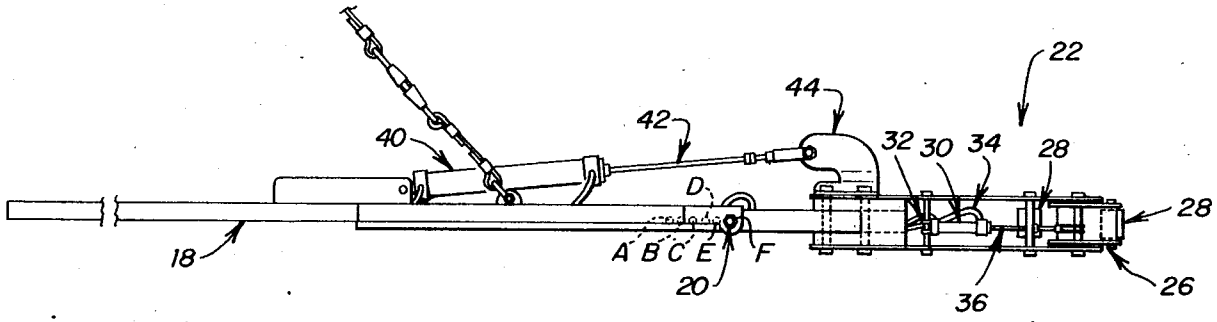
FIG. 3 is a side view of the assembly of FIG. 1.

Referring now to FIG. 3, a side view of the apparatus of figure one is illustrated as having a pneumatic cylinder 40 attached to piston arm 42 which connects to curve member 44 of casing alignment tool 22. Pivot point 20 is illustrated as a plurality of adjustment holes A, B, C, D, E, and F. For illustrative purposes casing alignment tool 22 is illustrated as being pivotally mounted through adjustment hole F.

In operation, a device such as a block is lowered to the ground to attach to a casing section. To provide the clearances necessary for the block to be lowered, pneumatic cylinder 40 is activated to draw piston 42 within cylinder 40 thus drawing curved member 44 towards cross member 18. When pneumatic cylinder 40 draws piston member 42 within casing alignment tool 22 is elevated to provide clearances for a block to lift a casing section to an upright position. (see FIG. 1)

Proper alignment may be selected by any method. For example, a plumline may be dropped from a centerpoint defined by rollers 28. However, the preferred embodiment positions casing alignment tool 22 after three or four sections of casing have been lowered to the bore hole. As indicated previously, casing sections may be put in place by the following method.

A casing section is raised to its vertical upright position by the use of a block and lowered into a bore hole to a point with an end of the casing section with a collar mounted thereon extending above the ground surface surrounding the bore hole. Slips may be used to hold the first section of casing in position while a second section is raised to vertical upright position and lowered to the collar of the first section. A man called a stabber is located on a platform at the end of the second casing opposite the end in the proximity of the collar of the first casing to align the centerline of the second casing with the centerline of the first casing. Hydraulic tongs may be attached to the uncollared end of the second casing to rotate the second casing and screw it into the collar of the first casing. The slips may then be opened and the combination of the first and the second casing lowered into the bore hole. The slips may then be closed to hold the collared end of the second casing in a position similar to that of the first casing to allow the addition of the third casing section. After several additional casings have been added, the last casing is left in its extended position from the bore hole. Casing alignment tool 22 may then be lowered against the collared end and adjusted for proper centering on the well bore.

Although manual alignment of the casing sections does not provide the acurate alignment of the present invention, manual alignment is sufficient at these first few non-critical sections of the casing. In general, the cementation at the bottom of a well bore will be the best throughout the length of the hole. Thus, sealing will not be a problem. Furthermore, the joints for the first few sections will not have to support the weight and will be supported by later joints. Since casing sections may weigh as much as ninety pounds per foot and each section is approximately forty feet long, the fifth joint will only have to support eighteen thousand pounds. Casing of that size will be rated in the near proximity of one million two hundred thousand pounds having a joint strength eighty percent of its support rating or nine hundred sixty thousand pounds. Although misaligned joint greatly reduces the joint strength, the weight that the fifth joint will have to support is less than two perccent of its rated joint strength.

Figure 4:
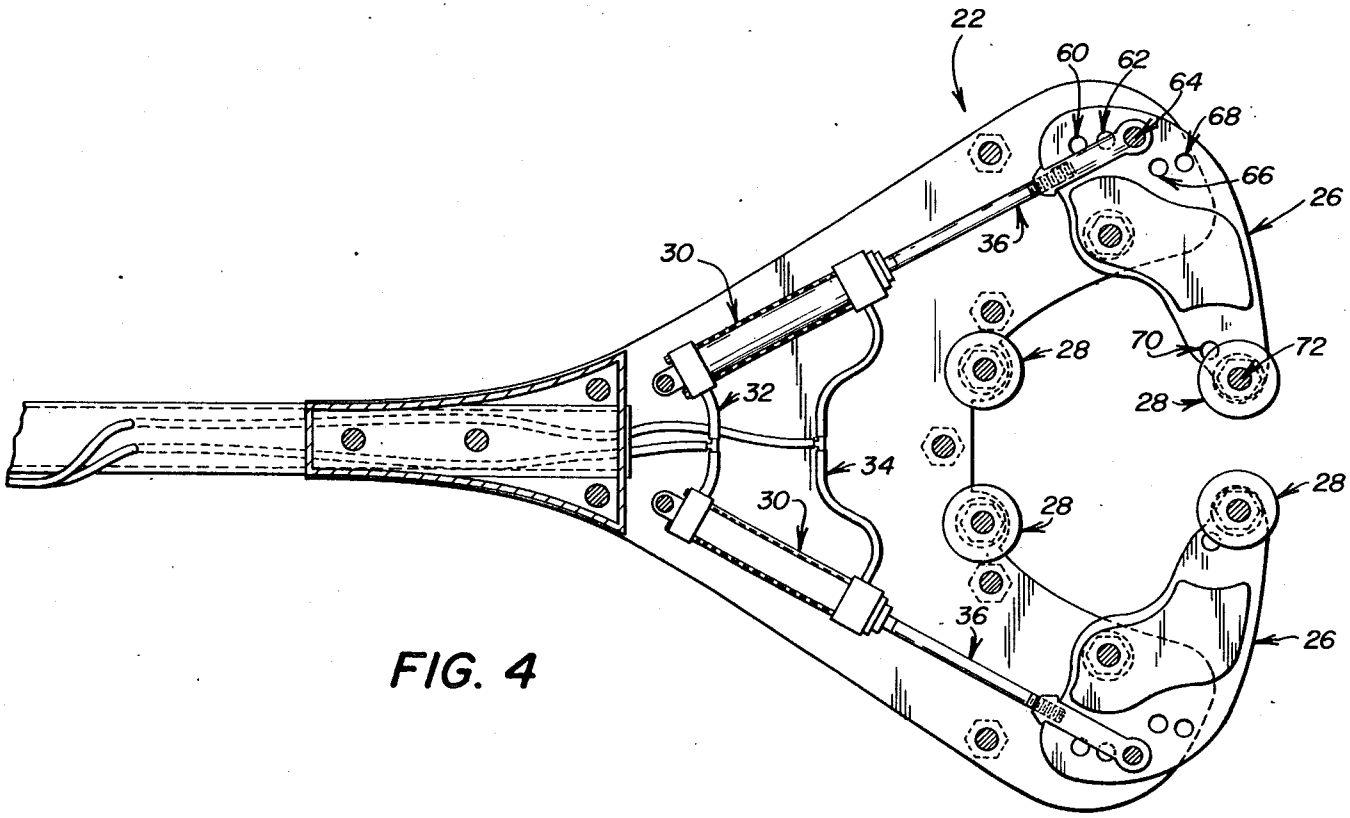
FIG. 4 is an enlarged view of a portion of FIG. 1.

Referring now to FIG. 4 an enlarged plan view of casing alignment tool 22 is shown in greater detail. Roller arm 26 is illustrated as having adjustment holes, 60, 62, 64, 66 and 68. Thus, casing alignment tool 22 may be used for a variety of sizes of casing from five inches to thirteen and three-eighths inches. In FIG. 3, piston 36 is connected to roller arm 26 at hole 64, which is for a nine inch casing. By connecting the end of piston 36 to hole 60, a five inch casing may be aligned. Similarly, hole 62 is for seven inch casing, hole 66 is for ten and three-fourths inch casing and hole 68 is for thirteen and three-eighths inch casing.

In operation, casing alignment tool 22 is lifted by pneumatic cylinder 40 to provide clearances for a block to be lowered to pick up a casing section. The preferred embodiment uses Miller Model A-84B pneumatic cylinder with a three and one-fourth inch bore and an eighteen inch working stroke. However, any similar device such as an equivalent pneumatic or hydraulic cylinder or a solenoid may be used to maintain casing alignment tool 22 in a standby position. Alternatively, casing alignment tool 22 may be configured to withdraw to a standby position instead of being raised to a standby position.

Prior to lowering casing alignment tool 22 to its alignment position, roller arms 26 are opened through pneumatic cylinders 30. Pneumatic cylinders 30 are operated by providing fluid pressure through fluid lines 34 urging pistons 36 to a withdrawn position rotating roller arms 26 to an open position.

When a casing has been elevated to a vertical upright position, casing alignment tool 22 may be lowered by pneumatic cylinder 40 through extension of piston arm 42. When casing alignment tool 22 is in its alignment position a casing section may be pulled against inner rollers 28 mounted on the fixed portion of casing alignment tool. When the casing section is in near proximity of inner rollers 28 pneumatic cylinders 30 may be energized through fluid pressure exerted through fluid line 32. Pressure exerted through fluid line 32 extend piston arms 36 drawing roller arms 26 to a closed position which clamps a casing section in a center of an area defined by rollers 28. When a casing section has been clamped by rollers 28, hydraulic tongs or the like may be attached to the end of the casing section and rotate the clamped casing section into the collared end of a previous casing section. Rollers 28 are rotatably mounted on the stationary portion of casing alignment tool 22 and the roller arms 26 of casing alignment tool 22. Since rollers 28 are rotatably mounted, a casing section may be rotated freely to screw it in to the collared section of a previous casing section providing a positive accurately aligned seal.

Roller arms 26 illustrates two possible positions for rollers 28. Position 70 may be used for rollers 28 for positioning casings having a seven inch or five inch outer diameter in place. Hole 72 may be used for the nine inch, ten and three-fourth inch and thirteen and three-eighth inch casings.

Hydraulic cylinders 30 may be of any type with sufficient strength to provide a positive clamp on casing sections by rollers 28 when energized. However, the preferred embodiment uses a Miller Model A-84-B pneumatic cylinder having a one and one-half inch bore with a five inch stroke. Piston rods 36 are preferably a five-eighth inch rod made of stainless steel. Rollers 28 may be of any type, however, three inch by four inch nylon rollers with floating shafts are preferred.

The present invention provides a method and apparatus for eliminating all the problems inherent in misalignment of casing sections in bore hole casing placement. Through the use of the present invention casing sections may be accurately aligned without a great deal of time and expense. Through the accurate alignment of the casing sections, a great amount of time and money is saved.

In the event of slant drilling, the casing alignment tool of the present invention may be easily adapted to an angled borehole by repositioning of casing alignment tool 22 or support frame 12.

While the present invention has been described by way of preferred embodiment, it is to be understood that the description is for illustration purposes only and the present invention should not be limited thereto but only by the scope of the following claims.

What is claimed is:

1. A casing alignment tool for aligning one section of casing within a derrick of a drilling rig positioned over a wellbore with another section of casing extending from said wellbore, said tool comprising:

a frame mounted in said derrick at a point adjacent the upper portion of said one section of casing:

a head assembly pivotably mounted to said frame, said head assembly comprising:

a yoke member having a recess in one end to receive said one section of casing;

means for pivotably connecting the other end of said yoke to said frame for movement about a horizontal axis;

means for rotating said yoke about said horizontal axis between a retracted position substantially parallel to have the vertical axis of said derrick and an operable position substantially perpendicular to the vertical axis of said derrick;

a plurality of roller means rotatably mounted on said yoke and extending into said recess whereby said roller means will engage said one section of casing when said casing is received in said recess;

a pair of roller arm assemblies being pivotably mounted on said yoke at respective sides of said recess;

means for moving each of said roller arm assemblies between an open position where said recess is free to receive said one section of casing and a closed position when said one section of casing will be held in said recess; each of said means for moving said roller arm assemblies comprising:

a power cylinder mounted on said yoke;

a rod operated by said power cylinder; and a plurality of spaced holes in said one end of each respective roller arm assembly whereby said respective rod can be selectively connected to one of said holes to thereby adjust said head assembly to receive casing havings different diameters;

roller means rotatably mounted on each roller arm assembly and positioned to extend into said recess to engage said one section of casing when said roller arm assemblies are in a closed position, said plurality of roller means on said yoke and said roller arm assemblies positioned so that the centerpoint of a circle passing through the axes of said roller means when said arm assemblies are in a closed position will be on the centerline of said wellbore; and wherein said means for pivotably connecting the other end of said yoke to said frame further includes:

a plurality of holes in said frame whereby one of said holes is aligned with a hole in said yoke to thereby adjustably position the centerpoint of said roller means with said centerline of said wellbore.

* * * * *